US005592076A

United States Patent [19]

Main et al.

[11] Patent Number: 5,592,076

[45] Date of Patent: Jan. 7, 1997

[54] BASE CURRENT SUPPLY CIRCUIT FOR MULTIPLE CURRENT SOURCES

[75] Inventors: William E. Main, Mesa; Jeffrey Durec, Chandler, both of Ariz.

[73] Assignee: Motorola, Inc., Schaumburg, Ill.

[21] Appl. No.: 497,966

[22] Filed: Jul. 3, 1995

[51] Int. Cl.[6] ..... G05F 3/16

[52] U.S. Cl. ..... 323/315; 323/312

[58] Field of Search ..... 323/312, 313, 323/314, 315, 316, 317

[56] References Cited

U.S. PATENT DOCUMENTS 5,512,815 4/1996 Schrader ..... 323/315

*Primary Examiner*—Stuart N. Hecker
*Assistant Examiner*—Shawn Riley
*Attorney, Agent, or Firm*—Robert D. Atkins

[57] ABSTRACT

A compensation circuit (26, 27, 28, 29) supplies base currents to a plurality of current sources (22, 25) attached to a regulator (50), thereby reducing the load on the regulator and improving overall circuit performance. The compensation circuit measures a single base current, multiplies it by the number of current sources to be supplied, and then provides the multiplied current to a base bus (40) coupled to the bases of the plurality of current sources. The compensation circuit has a very high output impedance with essentially no variation with supply voltage.

16 Claims, 2 Drawing Sheets

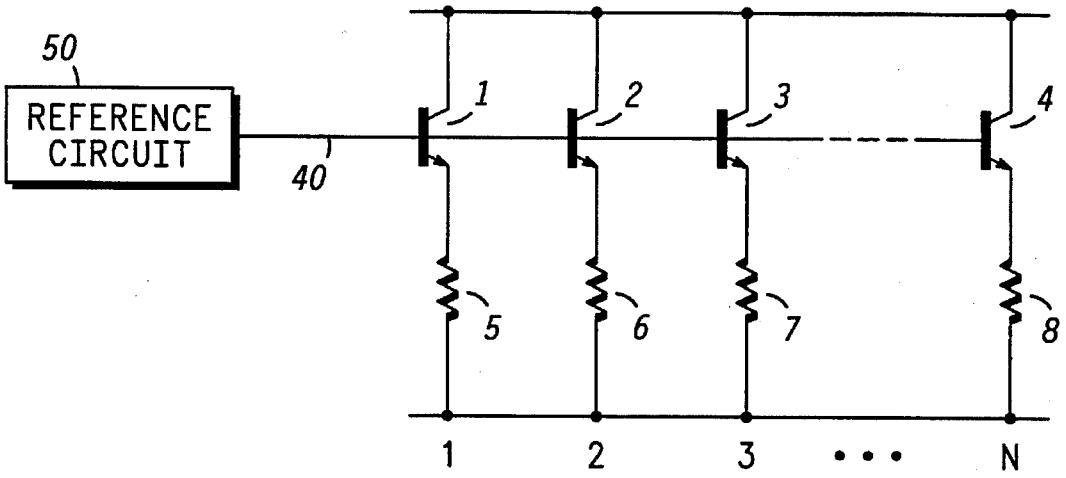
FIG. 1
-PRIOR ART-
FIG. 2
-PRIOR ART-
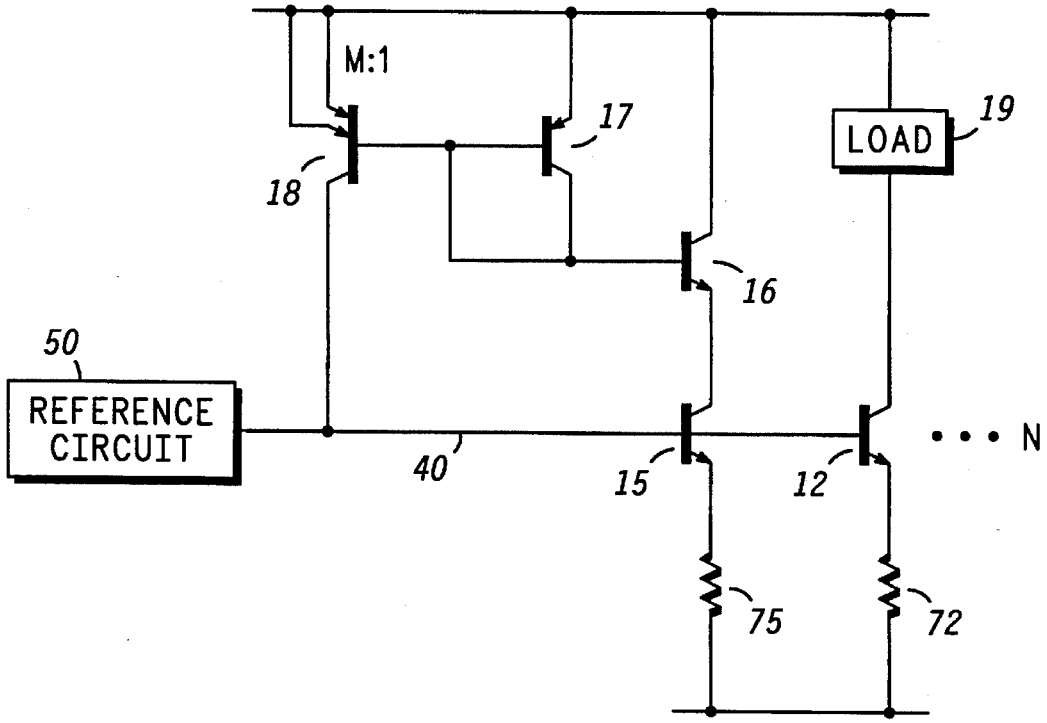

BASE CURRENT SUPPLY CIRCUIT FOR MULTIPLE CURRENT SOURCES

BACKGROUND OF THE INVENTION

The present invention relates generally to integrated circuits, and more particularly to an integrated circuit having multiple current sources controlled by a common reference.

It is common in integrated circuit design to have a number of current sources controlled by a single reference. The control is commonly accomplished by connecting the bases of the current source transistors to a common reference source. As additional current sources are added, the reference source must provide the additional base current for each added current source.

One prior art method of providing the additional base current is to measure the base current of one of the current sources, then provide a current to the control bus equal to the measured base current times the number of current sources connected to the control bus. This type of compensation has been accomplished in the past using a current mirror circuit where one side of the current mirror has been multiplied using multiple emitters equal to the number of current sources.

While such a compensation circuit should theoretically provide the desired result, it is not as accurate as desired due to base current errors in the mirror and its low output impedance which causes variations in compensation base current with supply voltage.

It would therefore be desirable to provide a circuit that does not vary with supply voltage and having a high output impedance to supply the required base currents for multiple current sources which are coupled to a common reference.

BRIEF DESCRIPTION OF THE DRAWINGS

FIG. 1 is a schematic diagram of a regulation circuit with multiple current sources;

FIG. 2 is a prior art schematic diagram of the regulation circuit with base current compensation to the multiple current sources;

DETAILED DESCRIPTION OF THE PREFERRED EMBODIMENT

Figure 3:
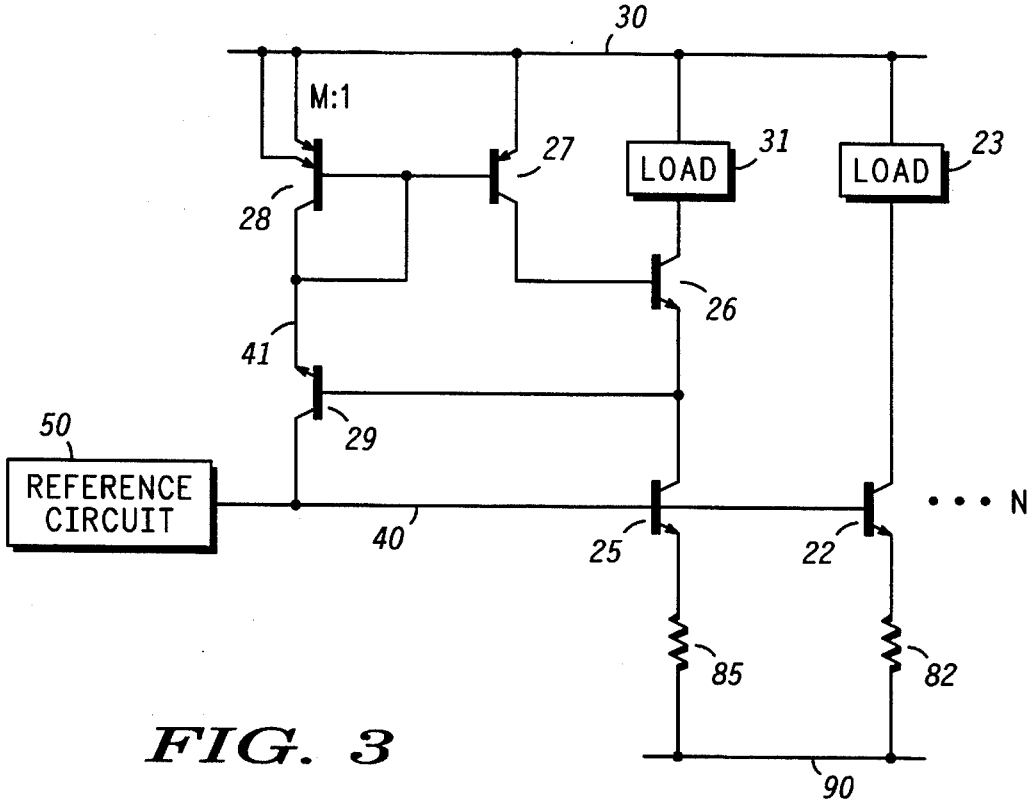
FIG. 3 is a schematic diagram of an embodiment of a compensation circuit providing base current compensation to multiple current sources.

It is common in integrated circuit design for a long string of current sources to be set up by some reference. An example is illustrated in FIG. 1 wherein multiple current source transistors 1, 2, 3, and 4 are controlled by regulator 50 coupled to base bus 40. Resistors 5, 6, 7, and 8 are used to set the desired operating point for transistors 1, 2, 3, and 4. While illustrated with four transistors, it is understood that any number could be attached as indicated by the reference numerals 1, 2, 3, and N adjacent to transistors 1, 2, 3, and 4, respectively.

As additional current sources are added, the regulation becomes degraded because regulator 50 must supply all of the base currents for transistors 1, 2, 3, and 4 via base bus 40. Various circuits have been used to provide these base currents from some other source, thereby reducing the current drain from regulator 50 and improving the overall circuit performance.

Illustrated in FIG. 2 is a prior art compensation circuit which attempts to provide the required base currents from the power supply. A current source 15 is cascoded through a transistor 16 whose base current is amplified and mirrored through transistor 17 and 18 back to base bus 40. In operation the base current of one of the current source transistors, in this case transistor 15, is estimated by noting that the base current of transistor 16 is the same as the base current of transistor 15. Since the collector of transistor 17 provides most of the base current to transistor 16, the collector current of transistor 17 is approximately equal to the base current of transistor 16, and therefore is approximately equal to the base current requirement for current source transistor 15.

The collector current of transistor 17 is multiplied in transistor 18 by the number of emitters M in transistor 18 where M is typically set equal to N. The collector of transistor 18 provides current to base bus 40. Resistors 72 and 75 are used to set the operating points of transistors 12 and 15, respectively, to allow transistor 12 to provide a constant current to load 19.

Although the current supply circuit in FIG. 2 should theoretically provide the required current, in practice a number of factors, including base current errors in the mirror and its low output impedance cause significant errors in the overall performance. As an example, the base current of transistor 16 includes not only the collector current of transistor 17, but also the base currents of transistors 17 and 18. As M becomes large, the value of the base current of transistor 18 approaches the value of the collector current in transistor 17, thereby altering the assumed relationship between the base current of transistor 16 and the collector current of transistor 17. In practice the theoretical amplification M must be increased empirically to offset these effects.

Illustrated in FIG. 3 is a schematic diagram of a compensation circuit of the present invention. Transistors 25 and 22 are current sources similar to transistors 15 and 12 of FIG. 2. Resistors 85 and 82 are coupled between the emitters of transistors 25 and 22 and ground conductor 90, respectively, and are used as required to set the desired operating points of transistors 25 and 22. Transistors 22 and 25 in turn provide constant currents to loads 23 and 31, respectively. The collector of transistor 26 is coupled through load 31 to a supply voltage 30 operating for example at 3.0 volts. The emitter of transistor 26 is coupled to the collector of transistor 25, and its base is coupled to the collector of transistor 27. The emitters of transistors 27 and 28 are coupled to supply voltage 30 and their bases are coupled to each other, to the collector of transistor 28, and to emitter 41 of transistor 29. The base of transistor 29 is coupled to the emitter of transistor 26, and its collector is coupled to an output of regulator 50 which is coupled to base bus 40 operating as the control input to the current source transistors 22 and 25.

In operation, the mirror comprising transistors 27 and 28 now runs in a feedback path and attenuates, rather than amplifies, thereby reducing its base current error. Current source transistor 25 turns on transistor 29 which turns on current mirror transistors 27 and 28. Transistor 27 feeds the base of transistor 26 which increases its conduction until it absorbs the current from transistor 25. Transistor 29 operates as a current divider in that its emitter receives collector current from transistor 28 and base currents from transistors 27 and 28 and divides the these input currents between its own collector current and base current.

The base current of the mirror is approximately equal to the base current of transistor 28 for large values of M. This would cause a base current error, except that the base current of transistor 29 is approximately equal to that of transistor 28. Since transistor 29 base current is subtracted as the current passes through transistor 29, the remaining collector current of transistor 29 is substantially equal to the collector current of transistor 28. As before, transistors 28 and 27 are ratioed in order that the collector current of transistor 28 is M times the collector current of transistor 27, where M is the number of current sources controlled by regulator 50 via base bus 40, e.g. M=N.

A measurement is made of a typical base current for the current sources, for example the base current of transistor 26. The collector current of transistor 27 is equal to the base current of transistor 26. The collector current of transistor 27 is multiplied in transistor 28 and passed through transistor 29 to base bus 40, and to the bases of the current source transistors connected thereto. The mirror base current is what caused some of the errors in the circuit of FIG. 2 because it was added to the base current of transistor 16 as it was used to measure the base current of current source transistor 15. By removing the mirror base current from the measured base current, the accuracy of the circuit is greatly improved.

Figure 4:
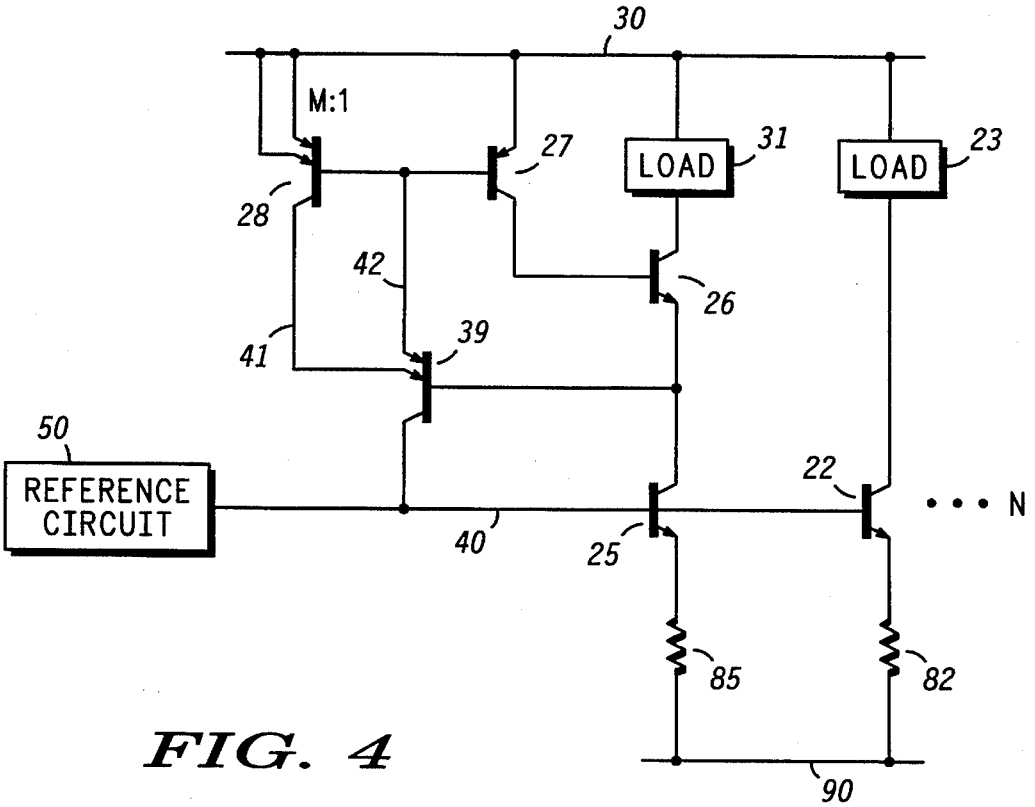
FIG. 4 is a schematic diagram of an alternate embodiment of the compensation circuit providing base current compensation to multiple current sources.
Figure 3:
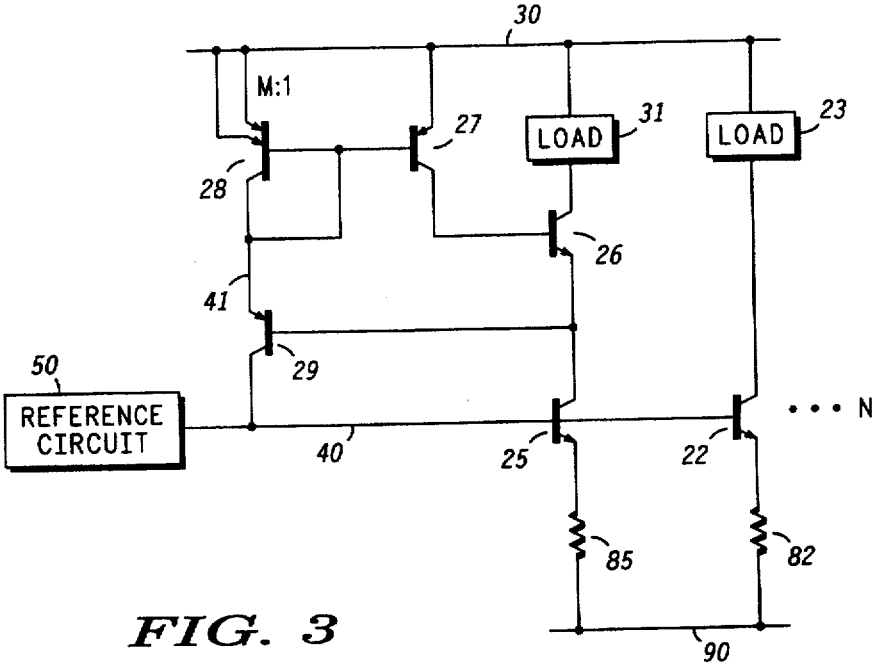
Figure 4:
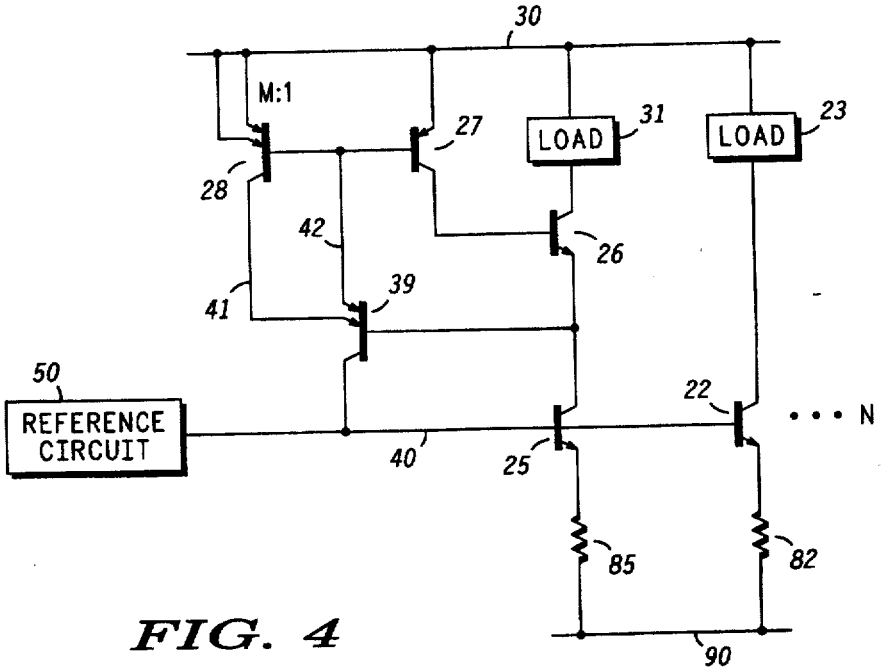

Shown in FIG. 4 is an alternative embodiment of the invention wherein the bases of transistors 27 and 28 are coupled to a second emitter 42 of transistor 39. The first emitter 41 of transistor 39 remains coupled to the collector of transistor 28 and all other connections remain the same as those depicted in FIG. 3. As with the previous embodiment, the collector current of transistor 39 is substantially equal to that of transistor 28. The base currents of transistors 27 and 28 are fed to second emitter 42 of transistor 39. The base current of transistor 39 is again approximately equal to that of transistor 28. Since transistor 39 base current is subtracted as current passes through transistor 39, the remaining collector current of transistor 39 is again substantially equal to the collector current of transistor 28.

As with the previous embodiment, transistors 28 and 27 are ratioed in order that the collector current of transistor 28 is equal to M times the collector current of transistor 27, where M is the number of current sources controlled by regulator 50 via base bus 40. Transistor 39 operates as a current divider in that its emitter 41 receives collector current from transistor 28 and its emitter 42 receives base currents from transistors 27 and 28 and divides these input currents between its own collector current and base current. The embodiment illustrates how common base and collector of transistor 28 in FIG. 3 could be routed to separate emitters of transistor 39 in FIG. 4.

By now it should be appreciated that the compensation circuit provides a compensation circuit for supplying accurate base currents to multiple current sources attached to a regulator, thereby reducing the load on the regulator and improving overall circuit performance. The compensation circuit has a very high output impedance and maintains essentially no variation with supply voltage. The compensation circuit is more stable than that of the prior art in FIG. 2, despite the high loop gain accuracy, due to the very dominant pole at the collector of transistor 27.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

What is claimed is:

1. A compensation circuit for supplying base currents to a plurality of current sources, comprising:

a current divider having a first output of said current divider coupled to a control input of the plurality of current sources, a second output of said current divider coupled to one output of the plurality of current sources, where a first current flowing into a first input of said current divider is substantially equal to current flowing out of said first output of said current divider, and a second current flowing into a second input of said current divider is substantially equal to current flowing out of said second output of said current divider;

a first transistor having a collector coupled to said first input of said current divider, an emitter coupled to a first power supply conductor, and a base coupled to said second input of said current divider;

a second transistor having a base coupled to said base of said first transistor, an emitter coupled to said first power supply conductor; and a third transistor having a base coupled to a collector of said second transistor, a collector coupled to said first power supply conductor, and an emitter coupled to said one output of the plurality of current sources.

2. The compensation circuit of claim 1 wherein said current divider comprises a fourth transistor having a first emitter coupled to said collector of said first transistor, a second emitter coupled to said bases of said first and second transistors, a base coupled to said emitter of said third transistor, and a collector coupled to said control input of the plurality of current sources.

3. The compensation circuit of claim 1 wherein said current divider comprises a fourth transistor having an emitter coupled to said collector of said first transistor and to said bases of said first and second transistors, a base coupled to said emitter of said third transistor, and a collector coupled to said control input of the plurality of current sources.

4. The compensation circuit of claim 1 wherein said first and second transistors are ratioed in order that said first transistor conducts M times the collector current of said second transistor, where M is equal to the number of the plurality of current sources.

5. The compensation circuit of claim 4 wherein said first transistor has N emitters coupled to said first power supply conductor, where N is equal to the number of the plurality of current sources.

6. The compensation circuit of claim 1 wherein the plurality of current sources includes a fourth transistor having a collector coupled to said emitter of said third transistor, a base coupled to said control input of the plurality of current sources, and an emitter coupled to a second power supply conductor.

7. The compensation circuit of claim 6 wherein the plurality of current sources further includes a fifth transistor having a collector coupled to first power supply conductor, a base coupled to said control input of the plurality of current sources, and an emitter coupled to said second power supply conductor.

8. A compensation circuit for supplying base currents to a plurality of current sources, comprising:

a first transistor having a collector coupled to a control input of the plurality of current sources and a base coupled to one output of the plurality of current sources;

a current mirror circuit referenced to a first power supply conductor and having an input coupled to an emitter of said first transistor; and a second transistor having a base coupled to an output of said current mirror circuit, a collector coupled to said first power supply conductor, and an emitter coupled to said one output of the plurality of current sources.

9. The compensation circuit of claim 8 wherein said current mirror circuit includes:

a third transistor having an emitter coupled to said first power supply conductor, a base and a collector coupled to said emitter of said first transistor; and a fourth transistor having an emitter coupled to said first power supply conductor, a base coupled to said base of said third transistor, and a collector coupled to said base of said second transistor.

10. The compensation circuit of claim 9 wherein said third and fourth transistors are ratioed in order that said third transistor provides M times the collector current of said fourth transistor, where M is equal to the number of the plurality of current sources.

11. The compensation circuit of claim 10 wherein said third transistor has M emitters coupled to said first power supply conductor, where M is equal to the number of the plurality of current sources.

12. The compensation circuit of claim 11 wherein the plurality of current sources includes:

a fifth transistor having a collector coupled to said emitter of said third transistor, a base coupled to said control input of the plurality of current sources, and an emitter coupled to a second power supply conductor; and a sixth transistor having a collector coupled to a first power supply conductor, a base coupled to said control input of the plurality of current sources, and an emitter coupled to said second power supply conductor.

13. A compensation circuit for supplying base currents to a plurality of current sources, comprising:

a first transistor having a collector coupled to a control input of the plurality of current sources and a base coupled to one output of the plurality of current sources;

a second transistor having a collector coupled to a first emitter of said first transistor, an emitter coupled to a first power supply conductor, and a base coupled to a second emitter of said first transistor;

a third transistor having a base coupled to said base of said second transistor, an emitter coupled to said first power supply conductor; and a fourth transistor having a base coupled to a collector of said third transistor, a collector coupled to said first power supply conductor, and an emitter coupled to said one output of the plurality of current sources.

14. The compensation circuit of claim 13 wherein said second and third transistors are ratioed in order that said second transistor provides M times the collector current of said third transistor, where M is equal to the number of the plurality of current sources.

15. The compensation circuit of claim 14 wherein said second transistor has M emitters coupled to said first power supply conductor, where M is equal to the number of the plurality of current sources.

16. The compensation circuit of claim 15 wherein the plurality of current sources includes:

a fifth transistor having a collector coupled to said emitter of said fourth transistor, a base coupled to said control input of the plurality of current sources, and an emitter coupled to a second power supply conductor; and a sixth transistor having a collector coupled to a first power supply conductor, a base coupled to said control input of the plurality of current sources, and an emitter coupled to said second power supply conductor.

* * * * *

UNITED STATES PATENT AND TRADEMARK OFFICE

CERTIFICATE OF CORRECTION

PATENT NO. : 5,592,076
DATED : January 7, 1997
INVENTOR(S) : Eric W. Main, et. al.

It is certified that error appears in the above-identified patent and that said Letters Patent is hereby corrected as shown below:

Title page, showing an illustrative Figure, should be deleted and substitute therefor the attached title page.

Delete drawing Figure 3, and substitute therefor the drawing figure, as showin on the attached page.

Signed and Sealed this

Twentieth Day of May, 1997

*Attest:*

Bruce Lehman

BRUCE LEHMAN

*Attesting Officer*

*Commissioner of Patents and Trademarks*

US005592076A

United States Patent [19]

Main et al.

[11] Patent Number: 5,592,076

[45] Date of Patent: Jan. 7, 1997

[54] BASE CURRENT SUPPLY CIRCUIT FOR MULTIPLE CURRENT SOURCES

[75] Inventors: William E. Main, Mesa; Jeffrey Durec, Chandler, both of Ariz.

[73] Assignee: Motorola, Inc., Schaumburg, Ill.

[21] Appl. No.: 497,966

[22] Filed: Jul. 3, 1995

[51] Int. Cl.[6] ..... G05F 3/16

[52] U.S. Cl. ..... 323/315; 323/312

[58] Field of Search ..... 323/312, 313, 323/314, 315, 316, 317

[56] References Cited

U.S. PATENT DOCUMENTS 5,512,815 4/1996 Schrader ..... 323/315

*Primary Examiner*—Stuart N. Hecker
*Assistant Examiner*—Shawn Riley
*Attorney, Agent, or Firm*—Robert D. Atkins

[57] ABSTRACT

A compensation circuit (26, 27, 28, 29) supplies base currents to a plurality of current sources (22, 25) attached to a regulator (50), thereby reducing the load on the regulator and improving overall circuit performance. The compensation circuit measures a single base current, multiplies it by the number of current sources to be supplied, and then provides the multiplied current to a base bus (40) coupled to the bases of the plurality of current sources. The compensation circuit has a very high output impedance with essentially no variation with supply voltage.

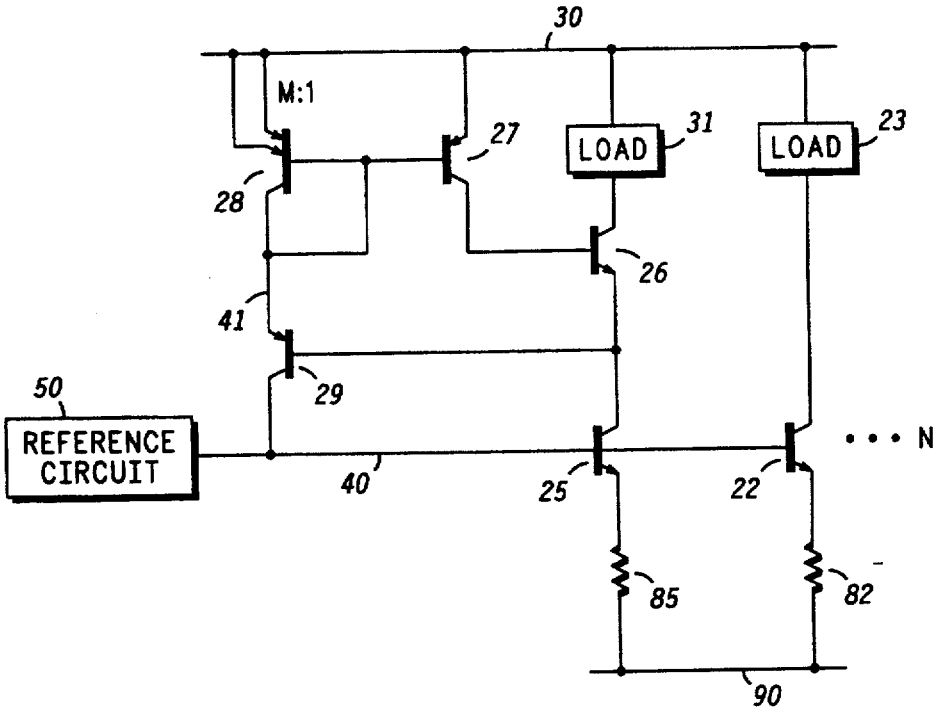

16 Claims, 2 Drawing Sheets